United States Patent [19]

Black

[11] Patent Number: 4,761,922

[45] Date of Patent: Aug. 9, 1988

[54] PARTITION WALL CONSTRUCTION

[76] Inventor: Brian E. Black, 24 Palatine Terrace, Christchurch, New Zealand

[21] Appl. No.: 942,129

[22] Filed: Dec. 16, 1986

[30] Foreign Application Priority Data

Dec. 16, 1985 [NZ] New Zealand ..... 214578

[51] Int. Cl.[4] ..... E04B 1/346

[52] U.S. Cl. ..... 52/71; 52/36; 52/238.1; 52/239; 52/741; 160/135; 160/351

[58] Field of Search ..... 52/36, 238.1, 239, 242, 52/243, 71, 70, 741; 160/135, 351

[56] References Cited

U.S. PATENT DOCUMENTS

| | | | |
|---|---|---|---|
| 1,981,240 | 11/1934 | McNeil | 52/242 X |
| 2,026,835 | 1/1936 | Irwin | 52/238.1 |
| 3,292,328 | 12/1966 | Lewis et al. | 52/238.1 |
| 3,757,485 | 9/1973 | Vincens | 52/238.1 |
| 3,797,184 | 3/1974 | Thompson . | |
| 4,103,465 | 8/1978 | McDonald, Jr. | 52/239 X |
| 4,194,313 | 3/1980 | Downing . | |
| 4,416,093 | 11/1983 | Salkeld et al. | 52/238.1 X |
| 4,516,619 | 5/1985 | Hasbrouck | 52/239 X |
| 4,624,083 | 11/1986 | Diffrient | 52/239 X |

FOREIGN PATENT DOCUMENTS

| | | | |
|---|---|---|---|
| 247112 | 9/1963 | Australia | 52/239 |
| 673886 | 11/1963 | Canada | 52/243 |
| 1307026 | 2/1973 | United Kingdom . | |
| 1356092 | 6/1974 | United Kingdom . | |
| 1480499 | 7/1977 | United Kingdom . | |

*Primary Examiner*—David A. Scherbel
*Assistant Examiner*—Richard E. Chilcot, Jr.
*Attorney, Agent, or Firm*—Cushman, Darby & Cushman

[57] ABSTRACT

A method of, and components for, constructing non-load-bearing partition walls which can be disassembled and rearranged, so that the walls are either free-standing or braced to an existing wall and/or floor and/or ceiling and so that the partition walls can be interconnected and positioned over a range of angles relative to another wall and sections of the partition wall can be positioned over the range of angles relative to adjacent sections.

66 Claims, 7 Drawing Sheets

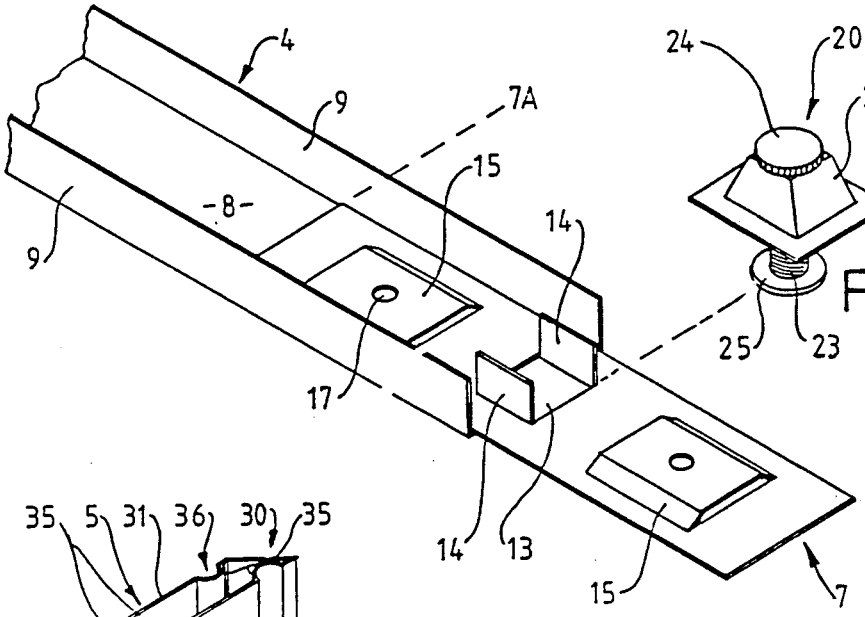
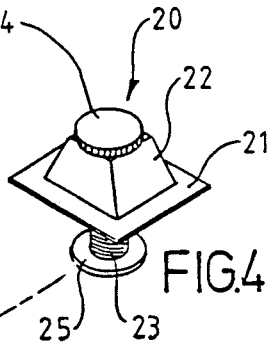
FIG.4
FIG. 2
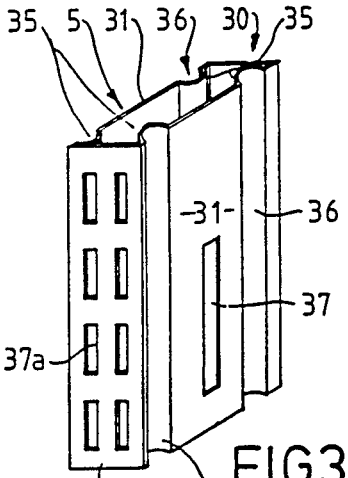
FIG.3
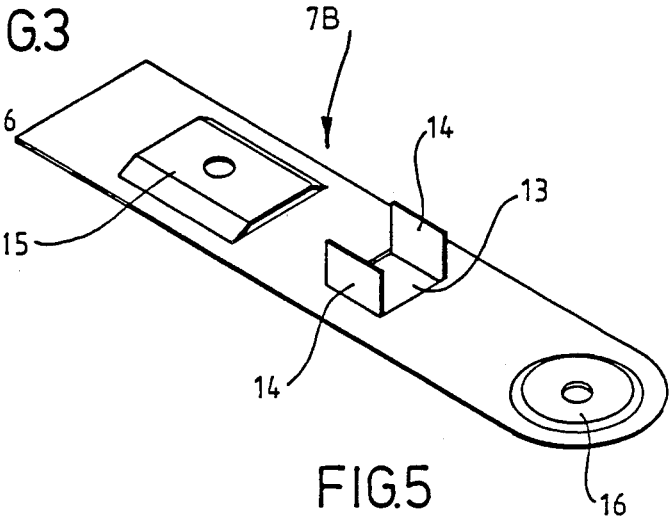
FIG.5

PARTITION WALL CONSTRUCTION

BACKGROUND OF THE INVENTION (a) Field of the Invention

The present invention relates to a method of, and components for, constructing partition walls. The term "partition wall" as used herein means a structural non-load-bearing wall.

The partition walls of the present invention are especially suited to shops, show-rooms or offices, where equipment such as display racks or shelving is to be supported from the walls, and will be described with particular reference to this application. However the partition walls also are useful for sub-dividing large open areas e.g. offices into a number of smaller areas.

The partition walls of the present invention are also one which can be disassembled and rearranged.

(b) Description of the Prior Art

Various types of prefabricated or pre-prepared partition walls have been used for partitioning a room or for providing walls especially suited to carry shelving or displays. However all have some the following disadvantages: taking considerable time or skill to erect; being non versatile, i.e. only one particular type of paneling may be used, or the panels must have edges that are shaped in a particular manner for the construction of the walls; some must be attached to the floor and sometimes the ceiling of a room for structural support; and being complex in nature, some are necessarily expensive.

Great Britain Pat. No: 1127371 and European Pat. No: 147801 each discloses a partition wall in which the panels must have a specific shape of grooves to define a cavity into which vertical elements are fixed. These elements are connected to a top and a bottom support or rail. In the completed wall the vertical elements are entirely hidden from view.

Australian Pat. No: 520230 discloses a partition wall in which the panels are fitted into a channel in a header and a footing. The header is fixed to the ceiling, and the footing is fixed to the floor of a room. There are no vertical elements or posts and the panels have complementary shaped edges so that adjacent panels may be fitted together.

Great Britain Pat. No; 1591571 discloses a plurality of shaped horizontal and vertical elements which are afixed to each panel, and connecting means. The partition wall of this patent may be free standing.

None of the above inventions provides partition walls in which the wall may be erected at any desired angle to an existing wall and where the panels within each wall may be at any desired angle to adjacent panels. Also none of the above disclose an inexpensive partition wall which is quick and easy to erect, nor do they provide a versatile partition wall which may use a variety of different panels without the requirement of special shaping on the edges of the panels.

BRIEF SUMMARY OF THE INVENTION

An object of the present invention is the provision of partition walls which are relatively inexpensive, versatile, can be quickly and easily erected, and which can be easily erected so that each panel may be at any required angle to any adjacent panel.

According to the invention there is provided a partition wall construction which includes: a series of channel members sections connected together with connecting plates to form a horizontal lower channel member; a series of channel member sections connected together with connecting plates to form a horizontal upper channel member; a series of vertical spaced wall posts, the upper end of each wall post being engaged with the upper channel member and the lower end of each wall post being engaged with the lower channel member; and one or more panels, the horizontal edges of each said panel being received within the upper and lower channel members, said panels being arranged so that at least one surface of each said wall post forms part of the external surface of the partition wall; said connecting plates being capable of interconnection over a range of angles such that any panel may be positioned relative to any adjacent panel over said range of angles, said range of angles lying between approximately 30 degrees and 330 degrees.

Preferably, the wall posts are shaped so as to be capable of engagably receiving a vertical edge of at least one said panel.

Preferably, each connecting plate provides: a portion for engaging the channel member section; an aperture for accommodating an adjusting means; and wall post engaging means for engaging the end of a wall post.

Preferably also, at least some of the connecting plates further provide pivotal connecting means whereby a connecting plate may be releasably pivotally secured to one or more similar connecting plates.

Preferably also, the partition wall construction further includes adjusting means to permit the lower channel member to be levelled when resting on a non-horizontal surface.

DETAILED DESCRIPTION OF THE PREFERRED EMBODIMENTS

By way of example preferred embodiments of aspects of the present invention are described in detail with reference to the accompanying drawings, in which:

FIG. 2 is an isometric view of part of a channel member and a first and second type of connecting plate;

FIG. 3 is an isometric view of part of a wall post;

FIG. 4 is an isometric view of a foot;

FIG. 5 is an isometric view of part of a third type of connecting plate;

Figure 1:
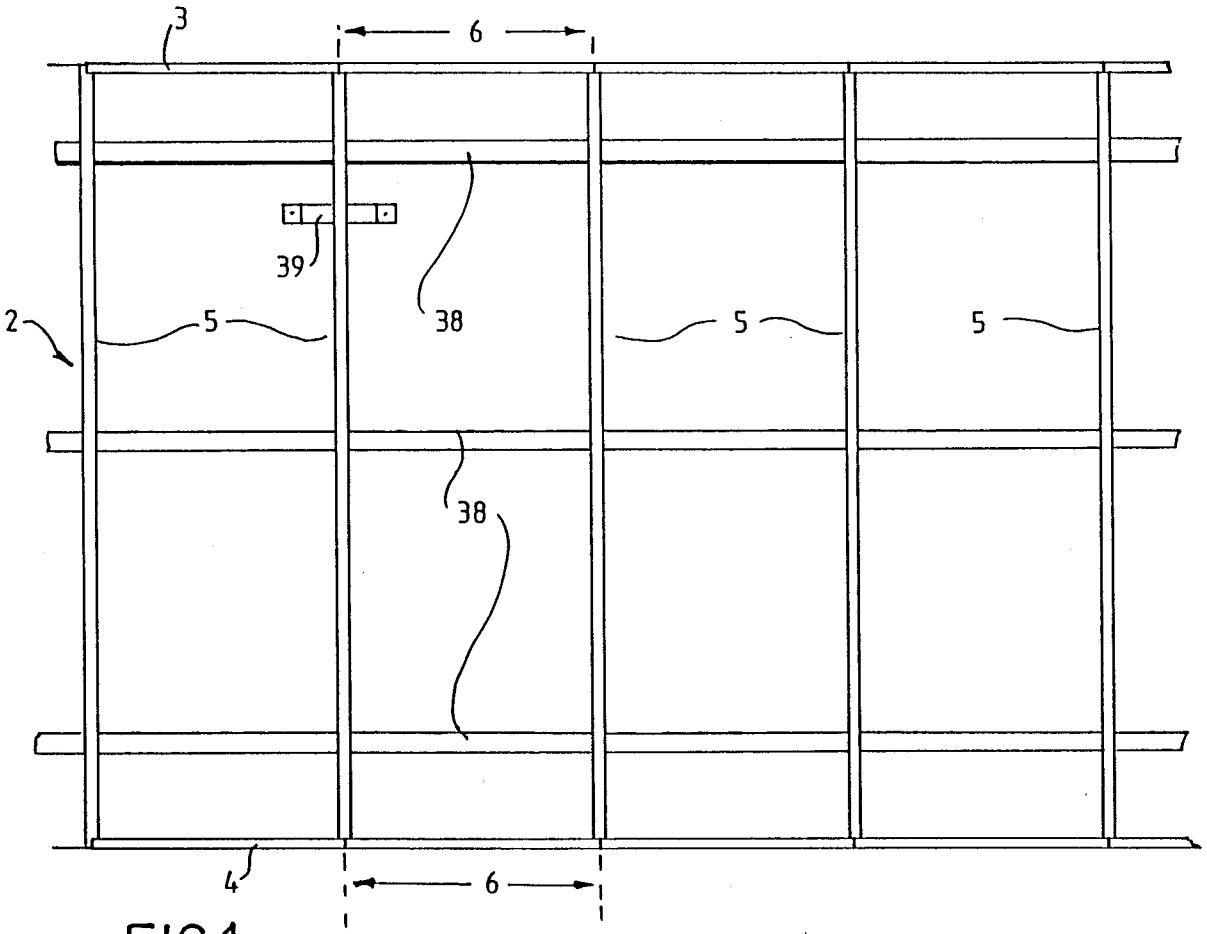
FIG. 1 is a diagrammatic side view of part of a partition wall in accordance with the present invention.

Referring to the drawings and in particular FIGS. 1–5, a partition wall 2 includes upper and lower horizontal channel members 3, 4 and a series of spaced vertical wall posts 5, connected together to form a framework in the vertical plane.

Each channel member 3, 4 is formed as a series of identical sections 6 which can be connected together by connecting plates 7 and *7a* or *7a* and *7b*. Each section 6 comprises a flat plate 8 with a lip 9 formed along each of the longer sides of the plate to form a channel, the planes of the lips 9 being substantially perpendicular to the plane of the plate 8.

Each section 6 is formed with a rectangular cut-out (not visible) adjacent each end, and adjacent each cut-out an apertured portion of the plate 8 is pressed outwards to project from the floor of the channel.

A first type of connecting plate 7 (FIG. 2) comprises a flat rectangular plate formed with a central rectangular hole 13 with a pair of flanges 14, each flange 14 lying in a plane substantially perpendicular to the plane of the plate 7 and substantially parallel to the longer sides of the plate 7. A pressed-up portion 15 is formed at each side of the hole 13; said portions 15 project upwards in the same direction as the flanges 14. Each of the portions 15 is dimensioned to be an easy sliding fit over the apertured portions formed in the channel member sections 6, and each portion 15 is formed with a hole 17 which is aligned with the hole in the apertured portion of section 6 when the portion 15 is engaged with said apertured portion in the section 6.

A shortened version 7A of the plate 7, comprising those portions between the broken lines in FIG. 2 is used at the ends of the wall 2, as hereinafter described.

A third type of connecting plate 7B (FIG. 5) comprises a hole 13, flanges 14, and a single pressed-up portion 15 all arranged in the same manner as described with reference to FIG. 2. However, instead of a second pressed-up portion 15, the plate is formed with an apertured boss 16 which projects upwards from the plane of the plate 7B in the same direction as the flanges 14 and the portion 15. The end of the plate 7B beyond the boss 16 is rounded off just beyond the boss 16.

If the surface on which the lower channel member 4 rests is uneven or not horizontal, all or part of the length of the channel member 4 may be supported upon feet 20, which are adjustable in height. Each foot 20 comprises an apertured bearing plate 21 to which a nut 22 is rigidly secured with the threaded hole of the nut coaxial with the aperture of the bearing plate 21.

A screw 23 with a plate 24, 25 secured to each end is engaged with the nut 22; the upper plate 24 is knurled so that it can be gripped easily, and the lower plate 25 provides a flat disc upon which the whole assembly rests. In use, the foot 20 is inserted where needed underneath the lower surface of the junction of two lower channel members 4, with the screw 23 and plate 24 projecting through the cut-outs in said members 4 and through the hole 13 of any connecting plate present. The bearing plate 21 of the foot 20 bears against the lower surface of the channel members 4 adjacent said cut-outs, and the screw 23 is rotated relative to the nut 22 until the channel members 4 are the desired height above the surface.

Each vertical wall post 5 (FIG. 3) is of box-section and has a cross-sectional shape which provides two parallel end faces 30, each of which is slotted, two parallel side faces 31, and two pairs of indented portions, one pair lying between each end face 30 and the adjacent parts of the side faces 31. On the outside of the post 5 said indented portions form a continuous groove 36 adjacent each outer edge of each side face, for retaining a panel as hereinafter described. On the inside of the post 5, said indented portions provide two pairs of continuous internal ribs 35. The grooves 36 may be of any shape, but are preferably arcuate.

The two parallel side faces 31 contain slots 37 at predetermined spaced intervals along the length of the wall post 5. The slots 37 are shaped so as to receive a span rail 38 or a wall fixing strap 39 as hereinafter described.

In use, each vertical wall post 5 is located at the junction of the aligned channel members 3, 4 and the top and bottom of the wall post 5 are located and held in position by sliding the flanges 14 of the corresponding connecting plate 7, 7A or 7B into the interior of the post 5. The flanges 14 are spaced apart by the distance between the pairs of ribs 35, so that the post 5 is a push-fit on the connecting plate 7, 7A or 7B.

A partition wall 2 is assembled from the above-described components as follows: a series of channel member sections 6 are connected together by connecting plates 7 to form a lower channel member 4 of the desired length, which is laid on the floor along the line of the wall to be erected. The connecting plates 7 are engaged with the channel member sections 6 by fitting the portions 15 of said plate 7 over the apertured portions formed in the adjacent channel member sections 6. This engagement generally is sufficient to hold the lower channel member 4 together, because in use the weight of the remainder of the wall 2 rests on the lower channel member 4 and holds it in place. However, for additional security, self-tapping screws may be inserted through the aligned holes in the plate 7 and the sections 6 respectively. The shortened version 7A of the connecting plate is used at the ends of the wall 2. The lower channel member 4 is levelled as necessary using feet 20 as described above.

Wall posts 5 are then secured to the lower channel member 4 by engaging each wall post 5 with the flanges 14 of the connecting plates 7 and 7A as described above. Depending upon the length of the channel member sections 6 and the desired strength of the wall 2, additional wall posts 5 may be needed between the wall posts 5 located at the ends of each channel member section 6. In this case said sections 6 are formed with one or more additional pairs of flanges 54 (shown in FIG. 10 only) which have the same dimensions as the flanges 14 and with which additional wall posts 5 can be engaged.

The upper channel member 3 is assembled in the same manner as the lower channel member 4, except that the channel member sections 6 and the connecting plates 7, 7A are always screwed together. The upper channel member 3 is positioned on top of the wall posts 5, with the flanges 14 of the connecting plates 7, 7A (and any additional flanges on the sections) engaged with the interior of the wall posts 5.

The upper channel member 3 may be secured to a ceiling or ceiling supports if the wall 2 is of ceiling height or braced back to an existing wall. Alternatively or additionally the lower channel 4 member may be secured to the floor.

One or more further partition walls extending at an angle to the above described partition wall are erected as follows: at each place along the upper and lower channel members 3, 4 where a further partition wall is to be connected, a connecting plate 7B is substituted for the connecting plate 7, with a second connecting plate 7B, aligned with the first, engaged with the continuation of the first partition wall 2 (if the additional walls are not added at the end of the first wall) and a third connecting plate 7B engaged with the channel members 3,4 of the further partition wall. The connecting plates 7B engage the respective channel members 3,4 in the same manner as plates 7, and the three connecting plates 7B are connected together by superimposing the bosses 16 of the plates 7B and securing them together with a bolt 40 through the holes 37 in said bosses; the bolt 40 is secured with a nut 41. The remainder of the further partition walls are constructed as described with reference to the first partition wall.

It will be appreciated that since the bosses 16 of the connectors 7B are pivotally secured together, the further partition walls can be arranged over a range of angles relative to the first wall 2. More than three bosses 16 can be superimposed, so that several further walls can be connected to the same place on the first wall 2.

Figure 6:
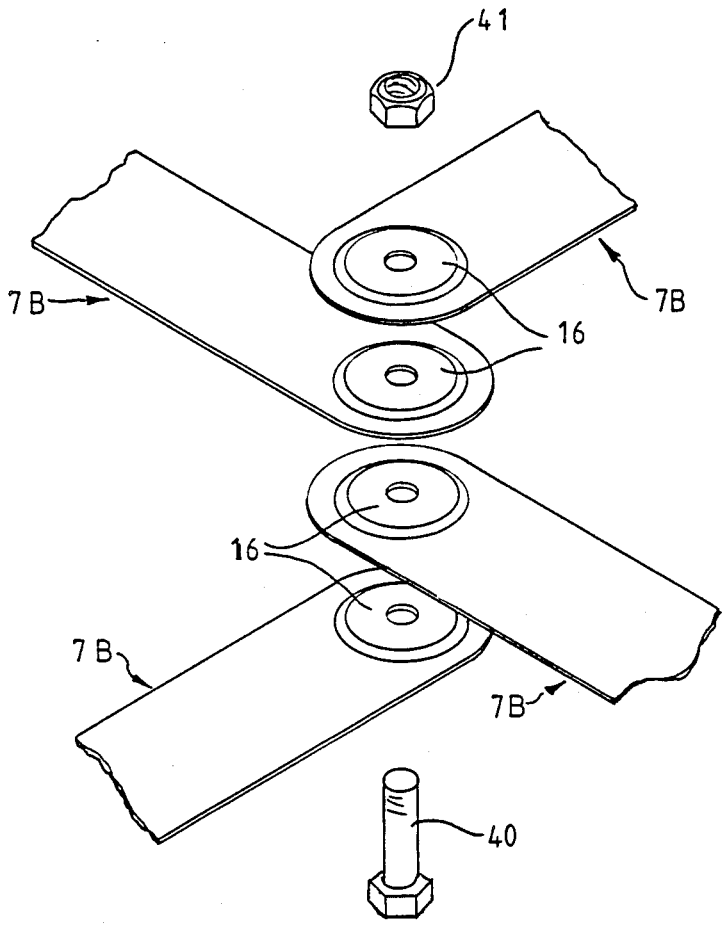
FIG. 6 is an exploded diagrammatic view of four connecting plates of the third type prior to assembly.

FIG. 6 shows the construction of such connecting plates when 4 walls are to be joined.

Figure 7:
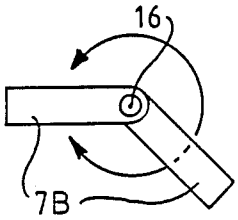
FIG. 7 is a diagrammatic plan view of two connecting plates of the third type.

FIG. 7 shows the connection of two connecting plates 7B and indicates that the wall joined to the existing wall 2 can be at any predetermined position over a range of angles. The range of angles is approximately 30 degrees to 330 degrees. The limitation on the angle that the two walls are set at is determined by the physical limitations of how close to parallel the two walls and connecting plates 7B can be, and by the angle at which it is desired to erect the second wall.

Figure 8:
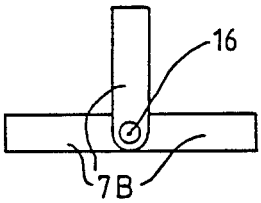
FIG. 8 is a diagrammatic plan view of three connecting plates of the third type.
Figure 9:
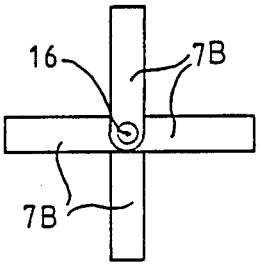
FIG. 9 is a diagrammatic plan view of four connecting plates of the third type.

FIGS. 8 and 9 show the arrangement of the connecting plates 7B when 3 and 4 walls, respectively, are arranged at right angles.

Figure 10:
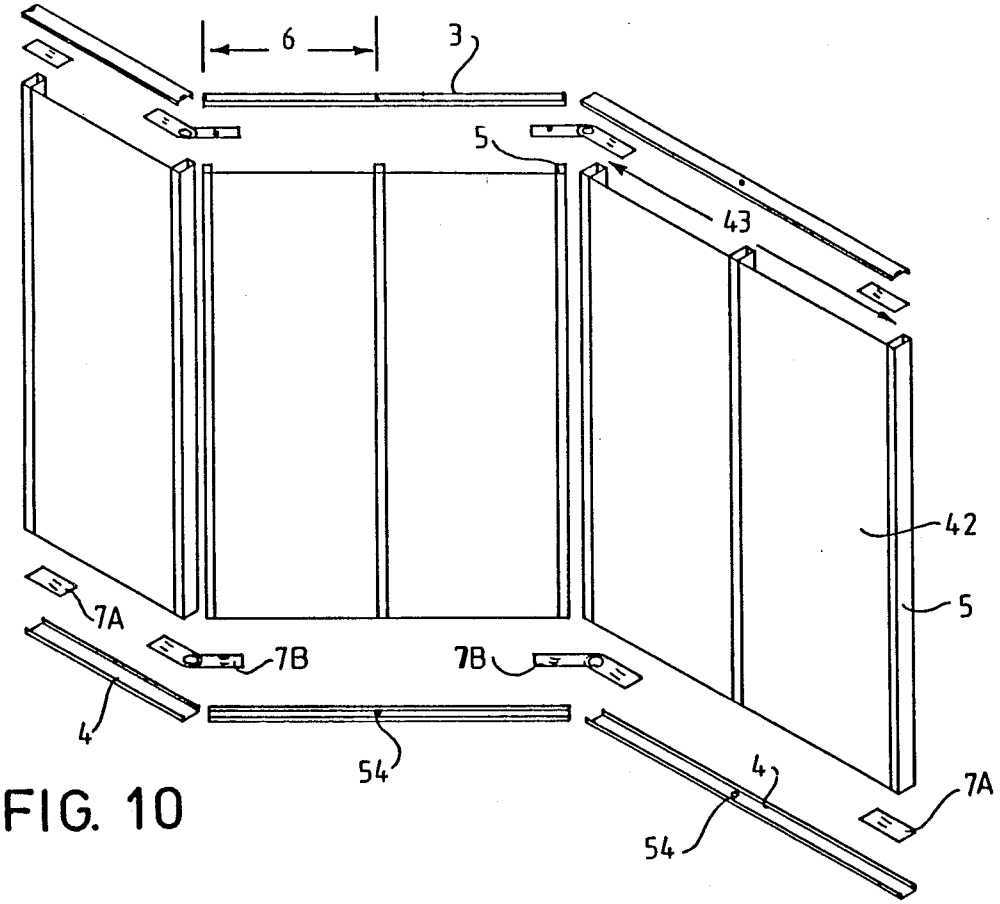
FIG. 10 is a diagrammatic perspective view of a partition wall constructed in accordance with the present invention.

Referring to FIG. 10, when one or more panels 42 are to be set at an angle to the adjacent panels 42, the connecting plates 7B are used to connect the upper and lower channel members 3,4 between the straight sections 43. An additional wall post 5 is added to the end of each straight section 43 so that each panel 42 within a straight section 43 of the wall 2 has a wall post 5 on each vertical edge. Each straight section 43 may contain one or more sections 6. The small gaps between the adjacent posts 5 connected to the connecting plates 7B may be filled in with a thin strip of panel material or other material, if so desired, the material being secured to each said post 5.

Depending on the height of the partition wall 2, the intended use, and whether or not the wall is to be free standing, it may be necessary to brace the wall at one or more places between the upper and lower channel members 3,4. This may be done by securing one or more span rails 38 between and through adjacent wall posts 5. FIG. 1 shows three such span rails 38, one adjacent each of the upper and lower channel members 3,4 and one positioned approximately in the middle of the length of the posts 5.

The span rails 38 may be so shaped as to engage a slot 37 in each vertical post 5 (FIG. 3). Alternatively, the span rails 38 may be shaped so as to engage the posts 5 at each end of the length of the rails 38, and to pass through any slots 37 in the posts 5 between the two ends of the rails 38.

If the partition wall 2 is to be erected parallel to and adjacent a pre-existing wall, it may be necessary or desirous to tie the partition wall 2 back to the pre-existing wall. This can be done with wall fixing straps 39. Each wall fixing strap 39 is shaped so that it can fit through a slot 37 in the posts 5, and can be secured to the pre-existing wall. The securing means can be bolts, screws or nails, as is desired.

The partition wall is clad with panels 42 so as to leave exposed the slotted front faces of the wall posts 5, so that shelf brackets, clothes racks and similar fittings can be engaged in the slots 37A (FIG. 3). The panels 42 may be of any suitable material. A relatively thin panel 42 may be secured by snap-fitting the edges of the panel 42 within the grooves 36 formed adjacent the slotted edges of the walls posts 5 (FIG. 3).

Panels constructed of peg board (i.e. a panel of wood or wood product with a series of holes over its surface) or of thin sheet metal may be secured to the posts 5 in this manner.

Figure 11:
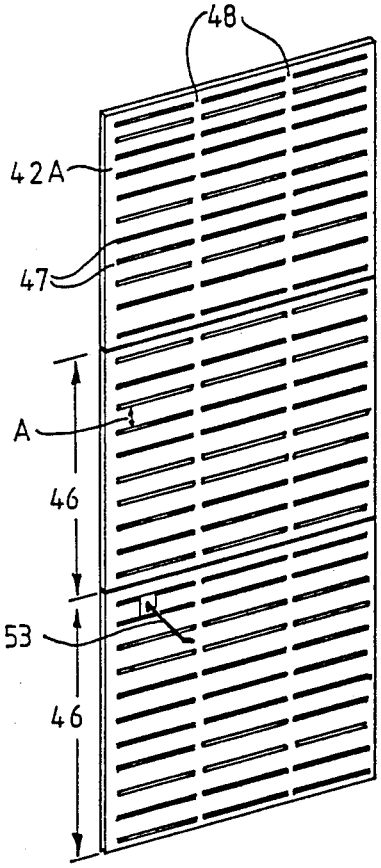
FIG. 11 is a perspective view of a first type of panel.
Figure 13:
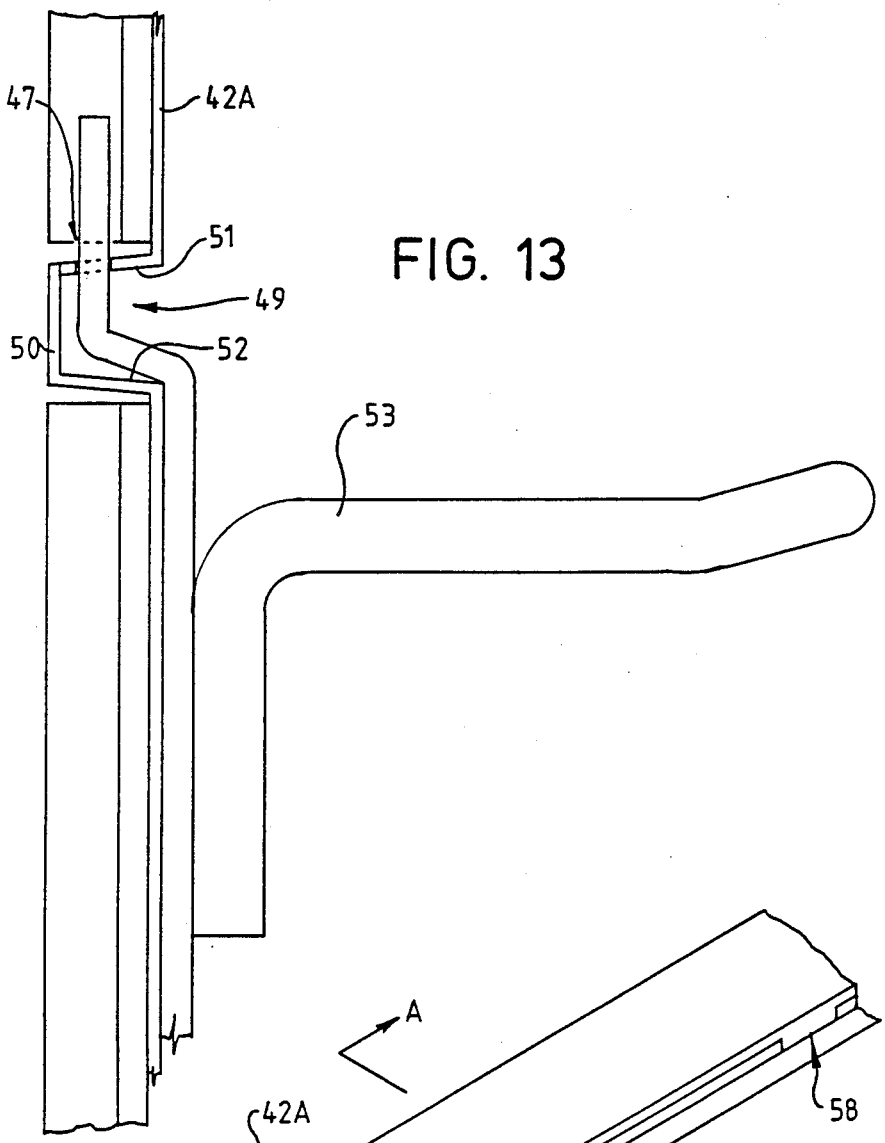
FIG. 13 is a sectional view of a panel along the line AA in FIG. 12.
Figure 12:
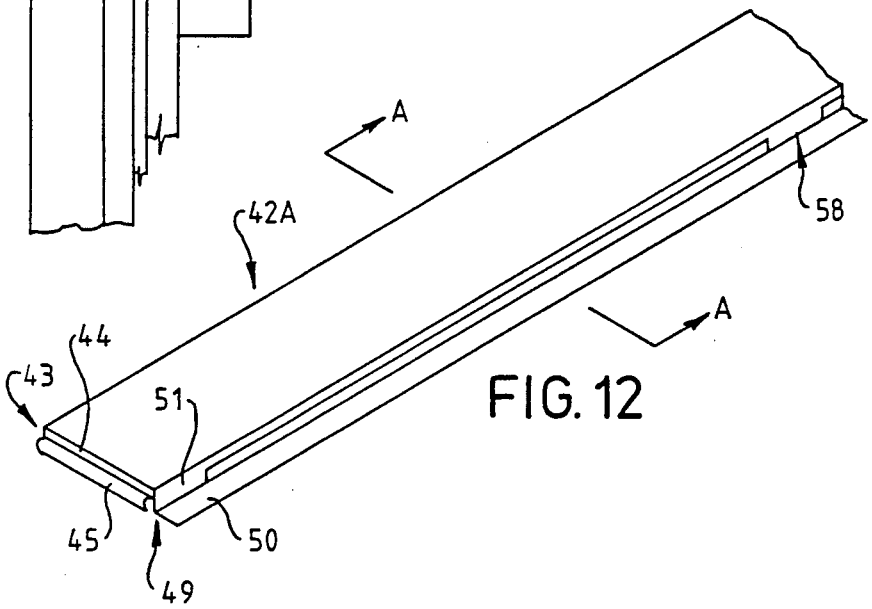
FIG. 12 is a perspective view of part of a panel of FIG. 11.

Alternatively the edges of the panel 42 may be specially shaped to snap-fit into the grooves 36 of the wall posts 5. FIGS. 11, 12 and 13 show a panel 42A, constructed from thin sheet metal.

Each vertical edge of the panel 42A forms flaps 43. Each flap 43 has a flat portion 44 and a curved portion 45. The curved portion 45 may be of a shape complementary to the shape of the grooves 36. Each flap 43 is positioned so that the flat portion 44 is at an angle slightly less than a right angle relative to the surface of the panel 42A. Thus, when the panel 42A is fitted into position between two wall posts 5, the flap 43 provides spring tension to aid in keeping the panel 42A in position.

Each flap 43 may be formed as a continuous flap down each vertical edge of the panel 42A or may be in sections 46 of uniform length down each vertical edge, with small gaps of uniform size between adjacent sections 46.

The panel 42A is formed with a series of regularly spaced transverse slots 47, so that brackets, racks and similar fittings can be arranged on the front of the panel 42A. The slots 47 cover the surface of the panel 42A with the exception of a small area adjacent the flaps 43 and two or more blank areas, or reinforcing ribs 48. The reinforcing ribs 48 are uniformly spaced across the width of the panel 42A and are vertically aligned.

The slots 47 may be cut directly into the front face of the panel 42A (as shown in FIG. 11). Alternatively, the panel 42A may be formed with transverse channels 49. Each channel 49 is formed with three substantially straight sides, the inner side 50 being substantially parallel with the face of the panel 42A. The upper side 51 contains the slots 47. The lower side 52 and upper side 51 of each channel 49 may be parallel or may be formed so that the sides 51, 52 taper outwardly towards the front of the panel 42A.

The gap 'A' between each transverse line of slots 47 maybe such that any brackets, racks and similar fittings 53 may be arranged on the face of the panel 42A in an optimal use of space. The structural strength of the panel 42A is not affected by the size of the gap A.

With this formation of the slots 47 any bracket, rack or similar fitting (53) may be securely arranged on the panel 42A, as shown in FIG. 13.

Figure 14:
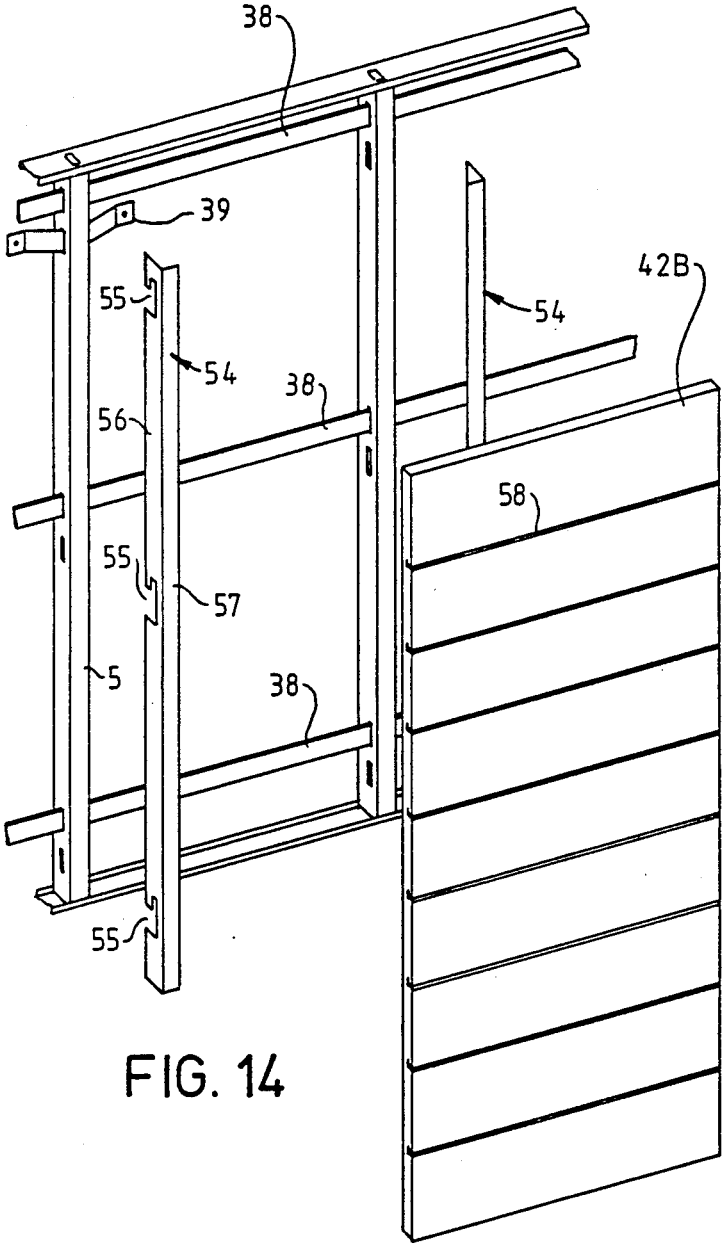
FIG. 14 is an exploded view of a second type of panel and panel wall construction in accordance with the present invention.

When panels of thicker material are used (e.g. thick steel, or wood or wood product panels), they may be attached in the manner described above. Alternatively a thick panel 42B may be attached to the posts 5 as follows: the partition wall 2 is constructed as described above, and three span rails 38 are included in the construction as shown in the positions in FIG. 1. As shown in FIG. 14, a length of angle iron 54 is attached to the span rails 38. The angle iron 54 is approximately the same length as the post 5 and includes three channel slots 55 along one angle edge 56. The slots 55 are positioned and shaped so as to enable the angle iron 54 to be hung from the span rails 38.

Each angle iron 54 is positioned adjacent a post 5 such that the second angle face 57 is outermost. Each angle iron 54 may be secured to the adjacent post 5, if so required. The panel 42B is rigidly secured to the second angle face 57. The width of the angle iron 54 is such that when the panel 42B is secured in place, the front surface of the panel 42B is approximately flush with the front surface 30 of the vertical wall posts 5.

The surface of the panel 42B may contain holes or slots 58. The slots 58 may be 'L' shaped and are formed entirely within the thickness of the panel 42B. Each slot 58 is formed transversely across the entire width of the panel 42B.

The components of the above described partition wall (apart from the panels) preferably are made of metal (e.g. coated or painted mild steel) but other suitable materials may be used if preferred.

The panels, as already described, may be made from wood, wood products, sheet metal (e.g. sheet steel) or any other suitable material. The sheet metal panel, described with reference to FIGS. 11–13 could be coated, painted or otherwise treated preferably before the panel is formed from the sheet metal. For preference the final layer is a clear epoxy coat for protection of the panel surface.

It will be appreciated that the panels 42, 42A and 42B may be used in the construction of the partition wall 2 either separately or in combination with each other.

I claim:

1. A partition wall construction, said wall having at least one external surface and including: a first series of channel member sections connected together with connecting plates to form a horizontal lower channel member; a second series of channel member sections connected together with connecting plates to form a horizontal upper channel member; a series of vertical spaced wall posts each having an upper and a lower end, the upper end of each wall post being engaged with the upper channel member and the lower end of each wall post being engaged with the lower channel member; and one or more panels each having two horizontal and two vertical edges, the horizontal edges of each said panel being received within the upper and lower channel members, said panels being arranged so that at least one surface of each said wall post forms part of the external surface of the partition wall; said connecting plates being capable of interconnection over a range of angles such that any panel may be positioned relative to any adjacent panel over said range of angles, said range of angles lying between about 30 degrees and 330 degrees.

2. A partition wall construction as claimed in claim 1 wherein said upper and lower channel members are formed from identical sections, each section comprising: a flat plate provided with two ends and two long sides; a lip formed along each of the long sides of the plate, the lips lying in a plane substantially perpendicular to the plane of the plate, said plate having a cut-out portion adjacent each end; and an apertured portion adjacent each cut-out portion, each said apertured portion protruding from said plate in a direction identical to the direction of said lips.

3. A partition wall construction as claimed in claim 1 wherein said wall further includes bracing means to brace the said wall back to an existing wall.

4. A partition wall construction as claimed in claim 1 wherein the construction parts, excluding the panels, are of metal.

5. A partition wall construction as claimed in claim 1 wherein the wall posts are shaped so as to be capable of engagably receiving one vertical edge of at least one said panel.

6. A partition wall construction as claimed in claim 5 wherein the partition wall construction further includes adjusting means to permit the lower channel member to be levelled when resting on a non-horizontal surface.

7. A partition wall construction as claimed in claim 5 wherein each connecting plate provides: a portion for engaging a channel member section; an aperture for accommodating an adjusting means; and wall post engaging means for engaging an end of a wall post.

8. A partition wall construction as claimed in claim 7 wherein a first type of connecting plate comprises: a flat plate which is rectangular in plan and so dimensioned as to be slidably receivable within one end of each of two adjacent sections; and two portions, one said portion engaging each of the channel member sections, one portion being on each side of the wall post engaging means which is positioned at the midpoint of the length of the said plate.

9. A partition wall construction as claimed in claim 7 wherein a second type of connecting plate comprises: a flat plate which is rectangular in plan and so dimensioned as to be slidably receivable within one end of one channel member section; said wall post engaging means being adjacent one end of said plate; and said portion for engaging a channel member section being adjacent the other end of said plate.

10. A partition wall construction as claimed in claim 7 wherein at least two of the connecting plates further provide a pivotal connecting means whereby a connecting plate may be releasably pivotally secured to one or more similar connecting plates.

11. A partition wall construction as claimed in claim 10 wherein a third type of connecting plate comprises: a flat plate with one straight end and an opposite arcuate end; a centrally positioned wall post engaging means; said portion for engaging a channel member section being adjacent said straight end; and a pivotal connection means adjacent said arcuate end.

12. A partition wall construction as claimed in claim 11 wherein said pivotal connection means comprises an apertured boss which projects outwardly from the flat plate in a direction identical to the direction of the wall post engaging means.

13. A partition wall construction as claimed in claim 7 wherein said upper and lower channel members are formed from identical sections, each section comprising: a flat plate provided with two ends and two long sides; a lip formed along each of the long sides of the plate, the lips lying in a plane substantially perpendicular to the plane of the plate, said plate having a cut-out portion adjacent each end; and an apertured portion adjacent each cut-out portion, each said apertured portion protruding from said plate in a direction identical to the direction of lips.

14. A partition wall construction as claimed in claim 13 wherein the portion of each connecting plate for engaging the channel member section comprises: a pressed up portion, said pressed up portion being dimensioned to be an easy sliding fit over one said apertured portion in each said section; and a hole formed in said pressed up portion which is aligned with a hole formed in the said apertured portion of said section when the pressed up portion is aligned with said apertured portion.

15. A partition wall construction as claimed in claim 13 wherein said wall post engaging means of each connecting plate comprises a hole and a pair of flanges, each flange being substantially perpendicular to the connecting plate and substantially parallel to the lips of the said section when the section and the connecting plate are secured together.

16. A partition wall construction as claimed in claim 15 further comprising an adjusting means to permit the lower channel member to be levelled when resting on a non-horizontal surface, said adjusting means being a foot which comprises: an apertured bearing plate; a nut rigidly secured to said bearing plate such that a threaded hole of the nut is co-axial with the aperture of the bearing plate; a screw, with an upper and a lower plate secured one to each end, being engaged with the nut, the lower plate providing a flat disc upon which the foot rests; the screw and upper plate being inserted through said hole in a connecting plate and said cut-out portion in a channel member section when a connecting plate is aligned with one channel member section.

17. A partition wall construction as claimed in claim 1 wherein each vertical wall post is provided with an exterior and an interior and is of box-section and has a cross-sectional shape which provides: two parallel end faces, each of which is slotted; two parallel side faces; and two pairs of indented portions, each pair lying between one end face and the adjacent side faces; the indented portions forming continuous grooves on the exterior of the wall post and internal ribs on the interior of the wall post.

18. A partition wall construction as claimed in claim 16 wherein each vertical wall post is provided with an exterior and an interior and is of box-section and has a cross-sectional shape which provides: two parallel end faces, each of which is slotted; two parallel side faces; and two pairs of indented portions, each pair lying between one end face and the adjacent side faces; the indented portions forming continuous grooves on the exterior of the wall post and internal ribs on the interior of the wall post.

19. A partition wall construction as claimed in claim 17 or claim 18 wherein each panel is dimensioned so as to be a snap fit within two opposed grooves, one on each of two adjacent wall posts.

20. A partition wall construction as claimed in claim 17 or claim 18 wherein each of the two parallel side faces contains vertically oriented slots at spaced intervals along the length of said post.

21. A partition wall as claimed in claim 20 wherein said grooves are arcuate.

22. A partition wall construction as claimed in claim 21 wherein each panel is dimensioned so as to be snap fitted within two opposed grooves, one on each of two adjacent wall posts.

23. A partition wall construction as claimed in claim 20 wherein the distance between the pairs of ribs is slightly greater than the distance between the pair of flanges of a connecting plate such that either end of the post may be push fitted over said pair of flanges of a connecting plate.

24. A partition wall construction as claimed in claim 23 wherein said wall further includes bracing means to brace said wall back to an existing wall, said bracing means comprising wall fixing straps, each said strap being engagable with one vertically oriented slot and securable at each end to an existing wall.

25. A partition wall construction as claimed in claim 24 wherein each panel is dimensioned so as to be a snap fit within two opposed grooves, one on each of two adjacent wall posts.

26. A partition wall construction as claimed in claim 23 wherein said wall includes additional bracing between adjacent wall posts, said additional bracing comprising one or more span rails, each span rail being positioned parallel to the upper and lower channel members, and engaged with some of the vertically oriented slots in the wall posts.

27. A partition wall construction as claimed in claim 26 wherein the or each span rail is formed in lengths equal to the length of one or more sections.

28. A partition wall construction as claimed in claim 26 wherein said partition wall construction further includes a plurality of angle iron posts each having two angled sides, said posts being of a length identical to the length of the wall posts, one angled side of each said angle iron post being slotted so as to slidably engage with the or each of the span rails, the second angled side being positioned to face outwards and such that a panel may be secured thereto, each said angle iron post being positioned adjacent a wall post and dimensioned so that the front of the secured panel is substantially flush with the exterior of the adjacent wall posts.

29. A partition wall construction as claimed in claim 28 wherein said wall further includes bracing means to brace said wall back to an existing wall.

30. A partition wall construction as claimed in claim 26 wherein each panel includes a front and a plurality of vertical edge flaps secured to the vertical edges of each panel, each flap being shaped so that the panel is a snap fit within two opposed grooves, one on each of two adjacent wall posts, such that when in position the front is substantially flush with the exterior of the wall post.

31. A partition wall construction as claimed in claim 30 wherein said panel is formed with a vertical series of spaced transverse slots, said transverse slots covering the front of the panel except for four or more narrow strips, one adjacent each vertical edge and the rest being evenly spaced across the width of the panel defining a plurality of vertical sets of slots.

32. A partition wall construction as claimed in claim 30 wherein one flap is continuous along the length of each of the vertical edges of said panel.

33. A partition wall construction as claimed in claim 30 wherein said flaps are of uniform length, and spaced apart by gaps along each of the vertical edges of said panel, said gaps being of uniform length.

34. A partition wall construction as claimed in claim 30 wherein each flap comprises a flat portion positioned at almost right angles to the front, and an arcuate portion which is shaped to fit into one of said grooves.

35. A partition wall construction as claimed in claim 30 or 34 wherein said wall further includes bracing means to brace said wall back to an existing wall.

36. A partition wall construction as claimed in claim 34 wherein said panel is formed with a vertical series of spaced transverse slots, said transverse slots covering the front of the panel except for four or more narrow strips, one adjacent each vertical edge and the rest being evenly spaced across the width of the panel defining a plurality of vertical sets of slots.

37. A partition wall construction as claimed in claim 36 wherein said slots are regularly spaced within each vertical set.

38. A partition wall construction as claimed in claim 36 wherein said slots are formed within indented transverse channels, each said channel being of a width identical to the width of the panel and comprising: an upper side, an inner side and a lower side; said inner side lying in a plane substantially parallel with the front of the panel; said upper side containing three or more slots and said upper and lower sides being substantially parallel and substantially perpendicular to the inner side.

39. A partition wall construction as claimed in claim 38 wherein the length of the flaps is the same as the distance between any two adjacent transverse channels.

40. A partition wall construction as claimed in claim 20 wherein said wall includes additional bracing between adjacent wall posts.

41. A partition wall construction as claimed in claim 40 wherein each panel contains a series of regularly spaced transverse slots, each slot being formed within the thickness of the panel and being 'L' shaped in cross section.

42. A partition wall construction as claimed in claim 41 wherein said panel is constructed of wood.

43. A partition wall construction as claimed in claim 41 wherein said panel is constructed of a wood product.

44. A partition wall construction as claimed in claim 41 wherein said partition wall construciton further includes a plurality of angle iron posts each having two angled sides, said posts being of a length identical to the length of the wall posts, one angled side of each said angle iron post being slotted so as to slidably engage with the or each span rails, the second angled side being positioned to face outwards and such that a panel may be secured thereto, each said angle iron post being positioned adjacent a wall post and dimensioned so that the front of the secured panel is substantially flush with the exterior of the adjacent wall posts.

45. A partition wall construction as claimed in claim 44 wherein said wall further includes bracing means to brace said wall back to an existing wall.

46. A partition wall construction as claimed in claim 17 or claim 18 wherein each panel includes a front and a plurality of vertical edge flaps secured to the vertical edges of each panel, each flap being shaped so that the panel is a snap fit within two opposed grooves, one on each of two adjacent wall posts, such that when in position the front is substantially flush with the exterior of the wall post.

47. A partition wall construction as claimed in claim 46 wherein said panel is formed with a vertical series of spaced transverse slots, said transverse slots covering the front of the panel except for four or more narrow strips, one adjacent each vertical edge and the rest being evenly spaced across the width of the panel.

48. A partition wall construction as claimed in claim 46 wherein one flap is continuous along the length of each of the vertical edges of said panel.

49. A partition wall construction as claimed in claim 46 wherein said flaps are of uniform length and spaced apart by gaps along each of the vertical edges of said panel, said gaps being of uniform length.

50. A partition wall construction as claimed in claim 46 wherein each flap comprises a flat portion positioned at almost right angles to the front, and an arcuate portion which is shaped to fit into one said groove.

51. A partition wall construction as claimed in claim 50 wherein said panel is formed with a vertical series of spaced transverse slots, said transverse slots covering the front of the panel except for four or more narrow strips, one adjacent each vertical edge and the rest being evenly spaced across the width of the panel defining a plurality of vertical sets of slots.

52. A partition wall construction as claimed in claim 51 wherein said slots are regularly spaced within each vertical set.

53. A partition wall construction as claimed in claim 51 wherein said slots are formed within indented transverse channels, each said channel being of a width identical to the width of the panel and comprising: an upper side, an inner side and a lower side; said inner side lying in a plane substantially parallel with the front of the panel, said upper side containing three or more slots and said upper and lower sides being substantially parallel and substantially perpendicular to the inner side.

54. A partition wall construction as claimed in claim 55 wherein the length of the flaps is the same as the distance between any two adjacent transverse channels.

55. A partition wall construction as claimed in claim 53 wherein each panel is formed integrally.

56. A partition wall construction as claimed in claim 55 wherein each said panel is constructed from sheet metal.

57. A partition wall as claimed in claim 18 wherein the distance between the pairs of ribs is slightly greater than the distance between the pair of flanges of a connecting plate, such that the end of the post may be push fitted over said pair of flanges of a connecting plate.

58. A method of constructing a partition wall having at least one external surface, said method including:

providing a plurality of channel member sections each comprising a flat plate having two end and two long sides and a lip formed on each of the long sides and lying in a plane substantially perpendicular to the plane of the plate, a plurality of wall posts each having an upper end and a lower end, one or more panels each having two horizontal and two vertical edges, a plurality of connecting plates to connect together the sections to form channel members and being capable of interconnecting the section over a range of angles lying between about 30° and 330°, each connecting plate having a portion for engaging a section, an aperture for accommodating height-adjustable foot means and wall post engaging means for engaging an end of a wall post and comprising a pair of flanges and height-adjustable foot means;

connecting together a plurality of the channel member sections with a connecting plate between adjacent sections to form a lower channel member;

connecting together an equal number of the channel member sections with connecting plates between adjacent sections to form an upper channel member and securing each connecting plate to said adjacent sections;

connecting four connecting plates one to each end of the channel members;

engaging the lower end of a wall post with the flanges of each of the connecting plates connecting together the lower channel member sections;

aligning the upper channel member such that the upper end of each wall post is engaged with the flanges of the corresponding connecting plates connecting together the upper channel member sections;

engaging the height-adjustable foot means with the aperture in the connecting plates connecting together the lower channel member sections; adjusting said foot means to ensure that the lower channel member is horizontal; and securing one panel between each two adjacent wall posts along one side of said wall.

59. The method as claimed in claim 58 wherein said connecting plates connecting adjacent channel member sections are a first type of connecting plate which comprises: a flat plate which is rectangular in plan and so dimensioned as to be slidably receivable within one end of each of two adjacent sections; and two portions for engaging the channel member sections, one on each side of a wall post engaging means which is positioned at the midpoint of the length of said first plate.

60. The method as claimed in claim 59 wherein said four connecting plates are a second type of connecting plate which comprises: a flat plate which is rectangular in plan and so dimensioned as to be slidably receivable within one end of one channel member section; a wall post engaging means positioned adjacent one end of said plate; and a portion for engaging said one channel member section adjacent the other end of said plate.

61. The method as claimed in claim 58 wherein any or all of the connecting plates between the sections are a third type of connecting plate which comprises: a flat plate with one straight end and an opposite arcuate end; a centrally positioned wall post engaging means; a portion for engaging a channel member section adjacent said straight end; and a pivotal connection means adjacent said arcuate end; and wherein said method further includes securing an additional wall post to each said third type of connecting plate in the lower and upper channel members, such that one or more sections of the wall may be set at a pre-determined angle to every adjacent section of the wall.

62. The method as claimed in claim 61 wherein said four connecting plates also are said third type of connecting plate.

63. The method as claimed in claim 62 further including: providing one or more further partition walls; and rigidly securing together the connecting plates at one end of each of the walls such that the partition walls are set at a predetermined angle in relation to one another.

64. The method as claimed in claim 58 further including securing the or each lower channel member to a pre-existing floor.

65. The method as claimed in claim 58 further including securing the or each upper channel member to a pre-existing ceiling.

66. The method as claimed in claim 58 further including securing said partition wall to a pre-existing wall with a plurality of wall fixing straps.

* * * * *